US008662497B2

(12) United States Patent
Pillard

(10) Patent No.: US 8,662,497 B2
(45) Date of Patent: Mar. 4, 2014

(54) STORAGE TRAY FOR STORING MAILPIECES

(75) Inventor: Romain Pillard, Avon (FR)

(73) Assignee: Neopost Technologies, Bagneux (FR)

( * ) Notice: Subject to any disclaimer, the term of this patent is extended or adjusted under 35 U.S.C. 154(b) by 828 days.

(21) Appl. No.: 12/649,683

(22) Filed: Dec. 30, 2009

(65) Prior Publication Data

US 2010/0187749 A1 Jul. 29, 2010

(30) Foreign Application Priority Data

Jan. 29, 2009 (FR) ..... 09 50547

(51) Int. Cl.
*B65H 1/00* (2006.01)

(52) U.S. Cl.
USPC ..... 271/145

(58) Field of Classification Search
USPC ..... 271/145, 162, 220, 221; 220/480, 676; 211/10, 11, 43, 184; 414/790.4; 399/393
See application file for complete search history.

(56) References Cited

U.S. PATENT DOCUMENTS

| | | | | |
|---|---|---|---|---|
| 4,807,758 | A * | 2/1989 | Hubbard | 206/555 |
| 4,817,260 | A * | 4/1989 | Martin | 29/426.6 |
| 4,826,147 | A * | 5/1989 | Shino et al. | 271/145 |
| 5,092,575 | A | 3/1992 | Ramsey | |
| 5,211,389 | A | 5/1993 | Roch et al. | |
| 2008/0122159 | A1 | 5/2008 | Pillard | |

FOREIGN PATENT DOCUMENTS

| | | | |
|---|---|---|---|
| EP | 0481415 | A1 | 4/1992 |
| EP | 1510480 | A1 | 3/2005 |
| EP | 1533260 | * | 5/2005 |
| EP | 1923340 | A1 | 5/2008 |
| FR | 1268119 | A1 | 7/1961 |
| FR | 2835244 | * | 8/2003 |
| JP | 6-9074 | * | 1/1994 |
| WO | 03/106289 | A1 | 12/2003 |

OTHER PUBLICATIONS

Machine translation of FR 2835244.*

* cited by examiner

*Primary Examiner* — Thomas Morrison
(74) *Attorney, Agent, or Firm* — Sughrue Mion, PLLC

(57) ABSTRACT

A storage tray for storing mailpieces for a mail-handling machine, which storage tray comprises a support wall, a first jogging wall adjacent and perpendicular to said support wall, and a second jogging wall adjacent and perpendicular both to said support wall and to said first jogging wall, these three walls meeting at a single junction point, the support wall being provided with at least one first slot for allowing motor-driven feed members of the mail-handling machine to pass through.

13 Claims, 2 Drawing Sheets

STORAGE TRAY FOR STORING MAILPIECES

FIELD OF THE INVENTION

The present invention relates to the field of mail handling and it relates more particularly to a storage tray for storing mailpieces for a mail-handling machine.

PRIOR ART

A mail-handling machine conventionally comprises three main elements: a feed module for feeding in mailpieces, a franking module or "postage meter" for franking said mailpieces, which franking module is disposed at the outlet of the feeder (and optionally includes a weigh device), and, disposed at the outlet of the franking module, a mailpiece-receiving module or stacker for the franked mailpieces. Currently, such a mail-handling machine can frank mailpieces of any type and of any format, and both the feed module and also the mailpiece-receiving module must be capable of loading and of receiving all of said mailpieces. In addition, for high processing rates, e.g. about 15,000 envelopes per hour (i.e. about 4 envelopes per second), in order to avoid frequent stopping of the machine, and in order to increase its storage capacity, the feed and mailpiece-receiving modules can be equipped with a plurality of moving support shelves making it possible to store the mailpieces by accumulation in a vertical position.

Unfortunately, such devices suffer from the drawback of being relatively voluminous, and above all of being specific to their function, i.e. dedicated either to loading or to receiving mailpieces.

OBJECT AND DEFINITION OF THE INVENTION

An object of the invention is to mitigate those drawbacks by proposing a compact and ergonomic storage tray that can be used equally well for loading a mail-handling machine or for receiving franked mailpieces. Another object of the invention is to propose a tray that is simple and very quick to fasten to its base, i.e. to mount and to remove.

These objects are achieved by a storage tray for storing mailpieces, which storage tray comprises a support wall, a first jogging wall adjacent and perpendicular to said support wall, and a second jogging wall adjacent and perpendicular both to said support wall and to said first jogging wall, these three walls meeting at a single junction point, said support wall being provided with at least one first slot adapted to allow external motor-driven members to pass through, and said jogging walls being provided with respective ones of two orifices formed symmetrically on either side of a single junction line along which said first and second jogging walls are united with each other, each of which orifices is adapted to receive, to the exclusion of the other orifice, a drive pin from an external motor-driven base.

Thus, with this configuration, the tray becomes reversible and can be used equally well for feeding in or for receiving mailpieces.

Advantageously, said support wall is further provided with at least one second slot that is adapted to allow other external motor-driven members to pass through, said at least one first and at least one second slots being symmetrical about a diagonal passing through said single junction point.

Preferably, said orifices have the same non-circular shape so as to avoid any movement in rotation of the storage tray about said drive pin.

Advantageously, each of said jogging walls has a trapezoid shape, said sides that form the junctions with said support wall forming the large bases of the trapezoids whose small bases formed by opposite parallel sides co-operate with the last sides that extend them slantwise to form one of the outer edges of the storage tray.

Preferably, said outer edges are formed without any sharp edges and are preferably rounded to avoid any risk of injury when taking hold of the mailpieces.

Advantageously, said support wall is united via a first one of its sides with said first jogging wall via a first side of said first jogging wall, and is united via a second one of its sides, disposed at 90° to its first side, with said second jogging wall via a first side of said second jogging wall, said two jogging walls being united with each other via second ones of their respective sides, perpendicular to said side that unites with said support wall, so as to enable said mailpieces to be jogged into abutment so as to be engaged fully into said storage tray.

Advantageously, said support wall is provided with a notch at its free corner that is opposite from said single junction point so as to impart substantially an L-shape to said support wall, or said support wall has a rectangular or square shape.

Preferably, said storage tray is made by one-piece molding of a plastics material or of metal.

The invention also provides a feed module of a mail-handling machine, which module comprises a motor-driven base provided with a plurality of drive pins and, fastened to said plurality of drive pins, a plurality of storage trays as mentioned above for loading mailpieces, and said invention also provides a mailpiece-receiving module of a mail-handling machine, which module comprises a motor-driven base provided with a plurality of drive pins and, fastened to said plurality of drive pins, a plurality of storage trays as mentioned above for unloading mailpieces.

BRIEF DESCRIPTION OF THE DRAWINGS

The characteristics and advantages of the present invention appear more clearly from the following description given by way of non-limiting indication and with reference to the accompanying drawings, in which.

DETAILED DESCRIPTION OF A PREFERRED EMBODIMENT

Figure 1A:
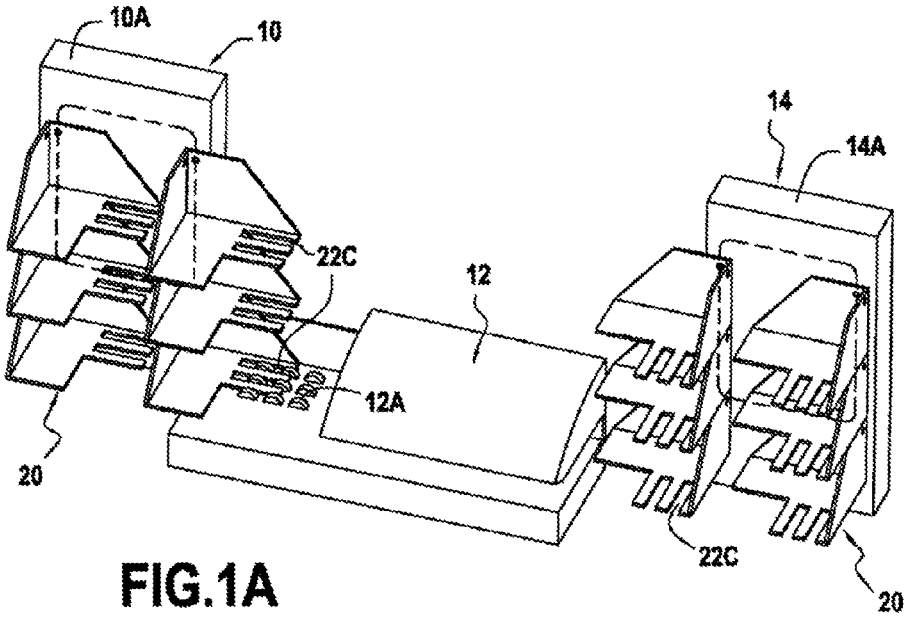
FIGS. 1A and 1B are perspective views of a mail-handling machine including respective ones of two embodiments of storage trays of the invention.
Figure 1B:
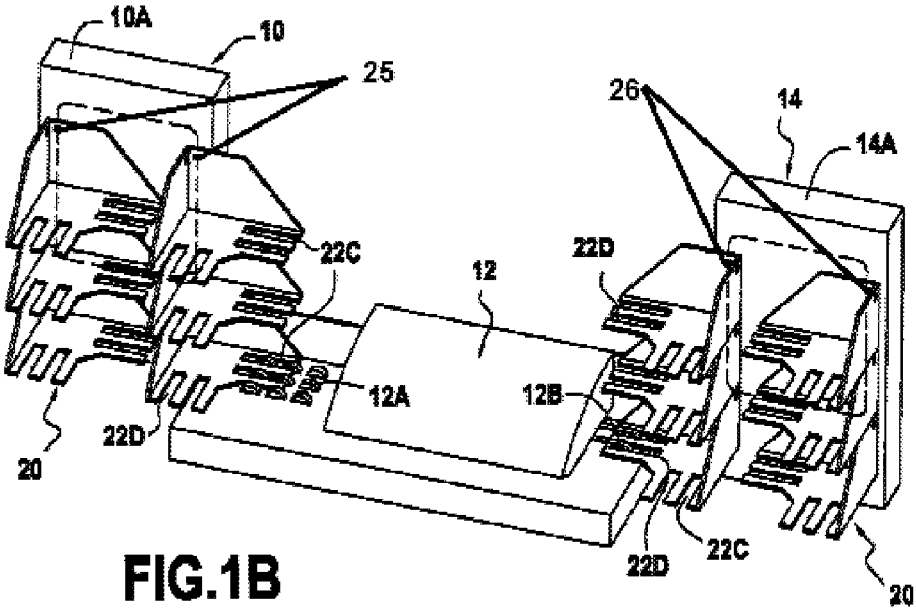

A conventional configuration of a mail-handling system is shown in FIGS. 1A and 1B. Going from upstream to downstream relative to the movement of the mailpieces, this configuration comprises a feed module 10 for feeding in mailpieces, a franking machine 12 for franking said mailpieces, and a mailpiece-receiving module 10 for receiving the franked mailpieces. The franking module can incorporate a selection station and a weigh station (not shown), and it can include drive members for conveying the mailpieces both at its inlet (rollers 12A) and at its outlet (belt 12B).

Figure 2A:
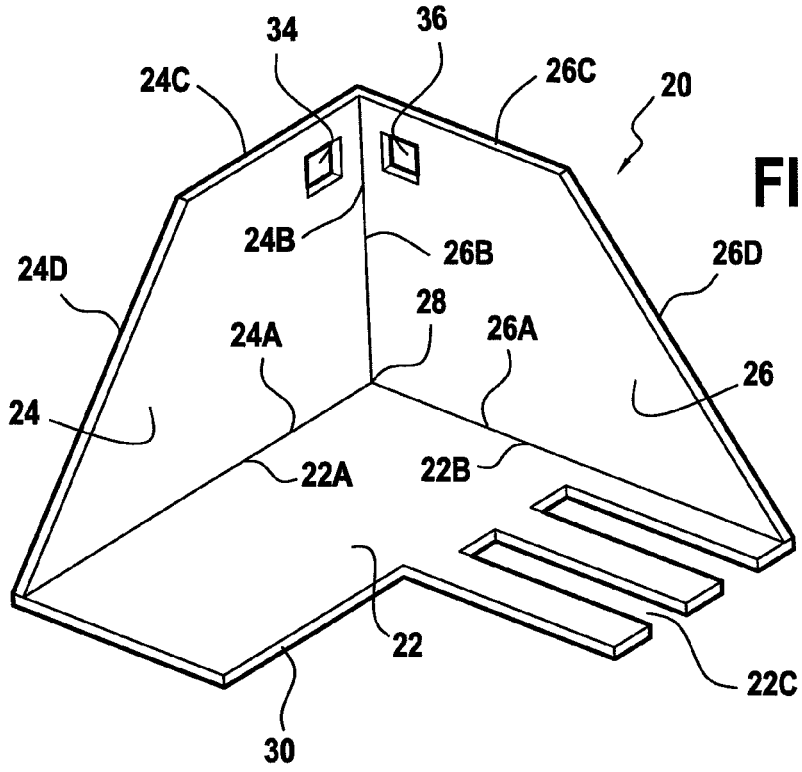
FIGS. 2A and 2B are detailed views of the two embodiments of a storage tray of the invention.

In accordance with the invention, the mailpiece feed and the mailpiece-receiving modules are both made up of the same components, namely each of them is made up of a motor-driven base 10A, 14A and of a plurality of storage trays 20. As shown by the first embodiment in FIG. 2A, each storage tray is made up essentially of three walls 22, 24, 26 that are mutually adjacent in pairs, each wall being adjacent via only one of its sides 22A & 24A; 24B & 26A; 26B & 22B with the other wall of the pair, and all three walls meet at a single junction point 28. More precisely, a support wall 22 of initially rectangular or square shape on which the mailpieces are to accumulate in a non-uniform stack (i.e. a stack mailpieces of different sizes and thicknesses), is united via a first one 22A of its sides with a first jogging wall 24 (via the first side 24A thereof), and is united via a second one 22B of its sides that is disposed at 90° to the first one of its sides with a second jogging wall 26 (via the first side 26A thereof), the two jogging walls being united with each other via respective second sides 24B, 26B thereof, the second side of each jogging wall being perpendicular to its first side, so as to enable the mailpieces to be jogged so as to be engaged fully into the storage tray into abutment against the junction between all three walls.

In order to enable the mailpieces to be driven by the conveyor means of the mail-handling machine, the support wall 22 is provided with at least one slot 22C for allowing the motor-driven feed rollers or belts 12A forming the conveyor means to pass through. The storage tray can thus be used equally well for feeding (loading) or for receiving (unloading) mailpieces, unloading then being performed merely by allowing the mailpieces to fall into the mailpiece-receiving tray.

When the tray is being used as a mailpiece feed tray, the second jogging wall 26 performs the function of a longitudinal wall for guiding the mailpieces, and the series of slots 22C enables the feed rollers 12A at the inlet of the franking module to pass through (see FIG. 1A). When the tray is being used as a mailpiece-receiving tray, the first jogging wall 24 performs the function of longitudinal wall guiding the mailpieces exiting from the franking module. In this second use, the series of slots 22C no longer has any function, and the second jogging wall 26 then merely provides a back jogging function for the mailpieces. In order to make it possible to take hold of the mailpieces more easily, the support wall can be provided with a notch 30 in its two free sides, then imparting an L-shape to it.

Figure 2B:
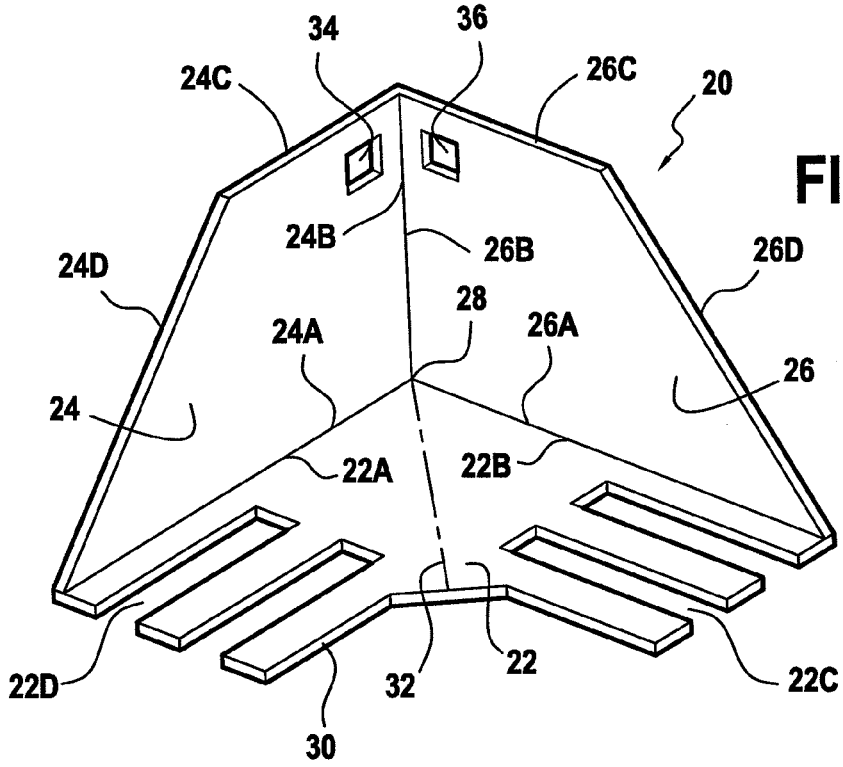

In a second embodiment shown in FIG. 2B, a second slot 22D designed to allow the motor-driven extraction belts or rollers 12B to pass through can also be disposed symmetrically about the diagonal 32 passing through the junction point 28 so as to enable the storage tray to be used equally well for feeding (loading) or for receiving (unloading) mailpieces. When it is being used as a feed tray, the second jogging wall 26 performs the function of a longitudinal guide wall for guiding the mailpieces, and the series of slots 22C makes it possible for the feed rollers 12A at the inlet of the franking module to pass through (see FIG. 1B). When the tray is being used for this use, the second series of slots 22D has no function and the first jogging wall 24 merely performs back jogging for the mailpieces. Conversely, when the tray is being used as a mailpiece-receiving tray, said first jogging wall 24 then performs the function of a longitudinal wall for guiding the mailpieces exiting from the franking module, the series of slots 22D enabling the extraction belts of the franking module to pass through (see FIG. 1B). In this second use, it is the series of slots 22C that no longer has any function, the second jogging wall 26 then merely performing back jogging for the mailpieces.

In order to make it possible to take hold of the mailpieces more easily, the two jogging walls 24, 26 are not of rectangular shape but rather they are of trapezoid shape, the sides 24A, 26A that form the junctions with the support wall 22 forming the large bases of the trapezoids whose small bases formed by the opposite sides 24C, 26C co-operate with the last sides 24D, 26D that extend them slantwise to form one of the outer edges of the storage tray. Likewise, the support wall 22 can also be provided with the same notch 30 in its free corner opposite from the junction point 28, thereby imparting substantially an L-shape to it. Preferably, the various edges of the storage tray are formed without any sharp edges, and are preferably rounded so as to avoid any risk of injury when taking hold of the mailpieces.

In order to make it possible to achieve a high processing rate, the storage tray is preferably mounted with other similar trays on a base 10A, 14A provided with suitable motor drive means for causing the various storage trays to be used in turn. In this way, it can be guaranteed that each of the storage trays can be put into place successively at the inlet or at the outlet of the franking module. Coupling each tray to the base is preferably implemented directly on the respective drive pin (25, 26) of said motor-drive means, which drive pin (25, 26) then advantageously has a section that is polygonal with n sides (n>2), e.g. triangular, square, or hexagonal, in order to prevent any movement in rotation of the storage tray about its own axis, and co-operates with a respective one of orifices 34, 36 having the same shape that are provided in respective ones of the two jogging walls on either side of their junction line.

The storage tray is advantageously made by one-piece molding of a plastics material or of metal. Thus, it is very easy to clean, and the ease with which it can be removed also makes it particularly easy to maintain. The ease and simplicity of loading/unloading is particularly advantageous, as is its compactness.

What is claimed is:

1. A mail-handling machine comprising:

a motor-driven base provided with a plurality of drive pins driven by said base; and a storage tray fastened to one of said drive pins for storing mailpieces, wherein said storage tray comprises a three wall structure consisting of a support wall, a first jogging wall adjacent and perpendicular to said support wall, and a second jogging wall adjacent and perpendicular both to said support wall and to said first jogging wall, these three walls meeting at a single junction point and there being no wall opposite any of said walls, said support wall being provided with at least one first slot that receives external motor-driven members of said mail-handling machine therein, and said first and second jogging walls being provided with respective ones of two orifices formed symmetrically on either side of a single junction line along which said first and second jogging walls are united with each other, each of which orifices receives to the exclusion of the other orifice, one of said drive pins from said motor-driven base.

2. A mail-handling machine according to claim 1, wherein said support wall of said storage tray is further provided with at least one second slot that receives other external motor-driven members therein, said at least one first and at least one second slots of said storage tray being symmetrical about a diagonal passing through said single junction point.

3. A mail-handling machine according to claim 1, wherein said orifices in said storage tray have the same non-circular shape so as to avoid any movement in rotation of the storage tray about said drive pins.

4. A mail-handling machine according to claim 1, wherein each of said first and second jogging walls on said storage tray has a trapezoid shape, said sides that form the junctions with said support wall forming the large bases of the trapezoids whose small bases formed by opposite parallel sides co-operate with the last sides that extend them slantwise to form one of the outer edges of the storage tray.

5. A mail handling machine according to claim 4, wherein said outer edges of said storage tray are formed without any sharp edges and are preferably rounded to avoid any risk of injury when taking hold of the mailpieces.

6. A mail-handling machine according to claim 1, wherein said support wall of said storage tray is united via a first one of its sides with said first jogging wall via a first side of said first jogging wall, and is united via a second one of its sides, disposed at 90° to its first side, with said second jogging wall via a first side of said second jogging wall, said two jogging walls being united with each other via second ones of their respective sides forming said single junction line, perpendicular to said side that unites with said support wall, so as to enable said mailpieces to be jogged into abutment so as to be engaged fully into said storage tray.

7. A mail-handling machine according to claim 1, wherein said support wall of said storage tray is provided with a notch at its free corner that is opposite from said single junction point so as to impart substantially an L-shape to said support wall.

8. A mail-handling machine according to claim 1, wherein said support wall of said storage tray has a rectangular or square initial shape.

9. A mail-handling machine according to claim 1, wherein said storage tray is made by one-piece molding of a plastics material or of metal.

10. A mail-handling machine according to claim 1, wherein said storage tray constituting a loading tray for a feed module, or an unloading tray for a mailpiece-receiving module of said mail-handling machine.

11. A mail-handling machine according to claim 10, wherein said feed module of said mail handling machine comprises said motor-driven base provided with said plurality of drive pins, and said mail handling machine further comprises a plurality of said storage trays fastened to said plurality of drive pins for loading mailpieces.

12. A mail-handling machine according to claim 10, wherein said mailpiece-receiving module of said mail handling machine comprises said motor-driven base provided with said plurality of drive pins, and said mail handling machine further comprises a plurality of said storage trays fastened to said plurality of drive pins for unloading mailpieces.

13. A mail-handling machine according to claim 1, wherein said support wall of said storage tray is a horizontal base wall and said first and second jogging walls of said storage tray are vertical.

* * * * *